US005483895A

United States Patent [19]

Tomek et al.

[11] Patent Number: 5,483,895

[45] Date of Patent: Jan. 16, 1996

[54] DETONATION SYSTEM FOR DETONATING EXPLOSIVE CHARGES IN WELL

[75] Inventors: Martin L. Tomek, Houston; Gregory N. Gilbert, Missouri City, both of Tex.

[73] Assignee: Halliburton Company, Dallas, Tex.

[21] Appl. No.: 415,538

[22] Filed: Apr. 3, 1995

[51] Int. Cl.[6] ..... F42R 3/00; F42C 15/34; F42C 9/06

[52] U.S. Cl. ..... 102/312; 102/325; 102/332; 102/251; 102/263; 102/277

[58] Field of Search ..... 102/312, 313, 102/325, 332, 250, 251, 263, 277

[56] References Cited

U.S. PATENT DOCUMENTS

| | | | |
|---|---|---|---|
| 2,977,883 | 4/1961 | Czajkowski | 102/245 |
| 3,190,219 | 6/1965 | Venghiattis | 102/325 X |
| 3,339,488 | 9/1967 | Borchers | 102/249 |
| 3,608,493 | 9/1971 | Aske et al. | 102/250 X |
| 3,960,082 | 6/1976 | Sloevsky et al. | 102/325 |
| 4,739,706 | 4/1988 | Golay | 102/271 |
| 4,807,530 | 2/1989 | Ishii et al. | 102/312 X |

*Primary Examiner*—Peter A. Nelson
*Attorney, Agent, or Firm*—Arnold White & Durkee

[57] ABSTRACT

In well perforating operations, it is necessary to detonate shaped charges suspended in the well. To avoid dangerous detonation at the surface, a pressure responsive mechanism is set to respond to a pressure indicative of operation at a selected depth. This pressure setting arms the detonator in cooperation with an electrical arming mechanism operative in response to a selected current flow at a required voltage for a selected interval.

15 Claims, 6 Drawing Sheets

DETONATION SYSTEM FOR DETONATING EXPLOSIVE CHARGES IN WELL

BACKGROUND OF THE INVENTION

The present invention relates generally to explosive equipment for use in wells, and more particularly relates to improved detonation systems for use with such explosive equipment, such as, for example, well perforating equipment.

As is well known, down hole explosive devices utilize a detonator to selectively initiate detonation of one or more explosive devices, such as, for example, shaped charges in a perforating gun. In the case of a perforating gun, the perforating gun, including the detonator, is assembled with a set of shaped charges at the earth's surface. Such an assembled perforating gun, however, is vulnerable to accidental detonation through exposure to mechanical shock, spark or electrical impulse. Premature detonation is extremely dangerous, presenting a risk not only of property damage, but also of injury or death to the personnel at or near the rig floor.

The risk of accidental detonation can be especially significant in offshore environments. When a drilling rig has been placed on location and a well has been drilled through a body of water into formations below the body of water, it is necessary to continuously operate electronic equipment at the drilling rig. For instance, radio transmitters typically operate continuously to provide markers for navigational purposes and the like. Typically, there are many transmitters that operate in or on drilling rigs or platforms located in bodies of water. These transmitters each potentially represent EMF sources and present a risk of detonation of explosive devices through induced voltages.

Safety precautions in the past have involved shutting down most electrically powered equipment in the area of the rig floor. This has involved switching off radio transmitters, welding machines and lighting systems. In part, this has been to prevent sparks, electrical charges and magnetic fields which might detonate the explosive charges. Such extraordinary precautions not only require extreme communication and effort to achieve; but are also prone to human or mechanical error which can then again create a dangerous situation at the well site.

Accordingly, the present invention provides a novel detonating system for an explosive device, providing redundant safety mechanisms to avoid the explosive device being susceptible to detonation at the earth's surface. The invention further provides a detonator in a system which is substantially immune to induced voltages from EMF sources.

SUMMARY OF THE INVENTION

The present invention provides a safe detonator system for use in well perforating equipment, such as equipment including shaped charges. The detonator system is interlocked against firing while at the surface. As with prior detonator systems, the perforating assembly, including the detonator, is lowered into a well borehole. When the detonator of the present invention is placed in the well borehole, however, it is not automatically armed for detonation.

The detonator system in accordance with the present invention utilizes redundant safety mechanisms, requiring that two "arming" conditions be achieved before detonation is permitted. In one preferred embodiment, one of the two pre-detonation conditions involves lowering the detonator system into the well to such a depth that the hydrostatic pressure in the well is at a requisite level to provide a first arming condition. As a second arming condition, the system requires that a current of a specified level be provided to the detonator system for a predetermined duration. Requiring this second condition minimizes spark sensitivity, and reduces sensitivity to EMF radiation from transmitters in the near vicinity.

In one particularly preferred embodiment, the detonator in accordance with the present invention utilizes a meltable retention member. The retention member is melted by the application of a generally predetermined amount of heat, initiated by application of an electric current over time to a heating element. In this particularly preferred embodiment, application of the electric current is precluded until a hydrostatic pressure responsive switch has been actuated. In another preferred embodiment, after actuation of an annulus pressure responsive switch, an electrical signal may be applied to a motor to operate a pump for a specified interval to hydraulically move components within the system to arm the detonator.

DETAILED DESCRIPTION OF THE PREFERRED EMBODIMENTS

Figure 1:
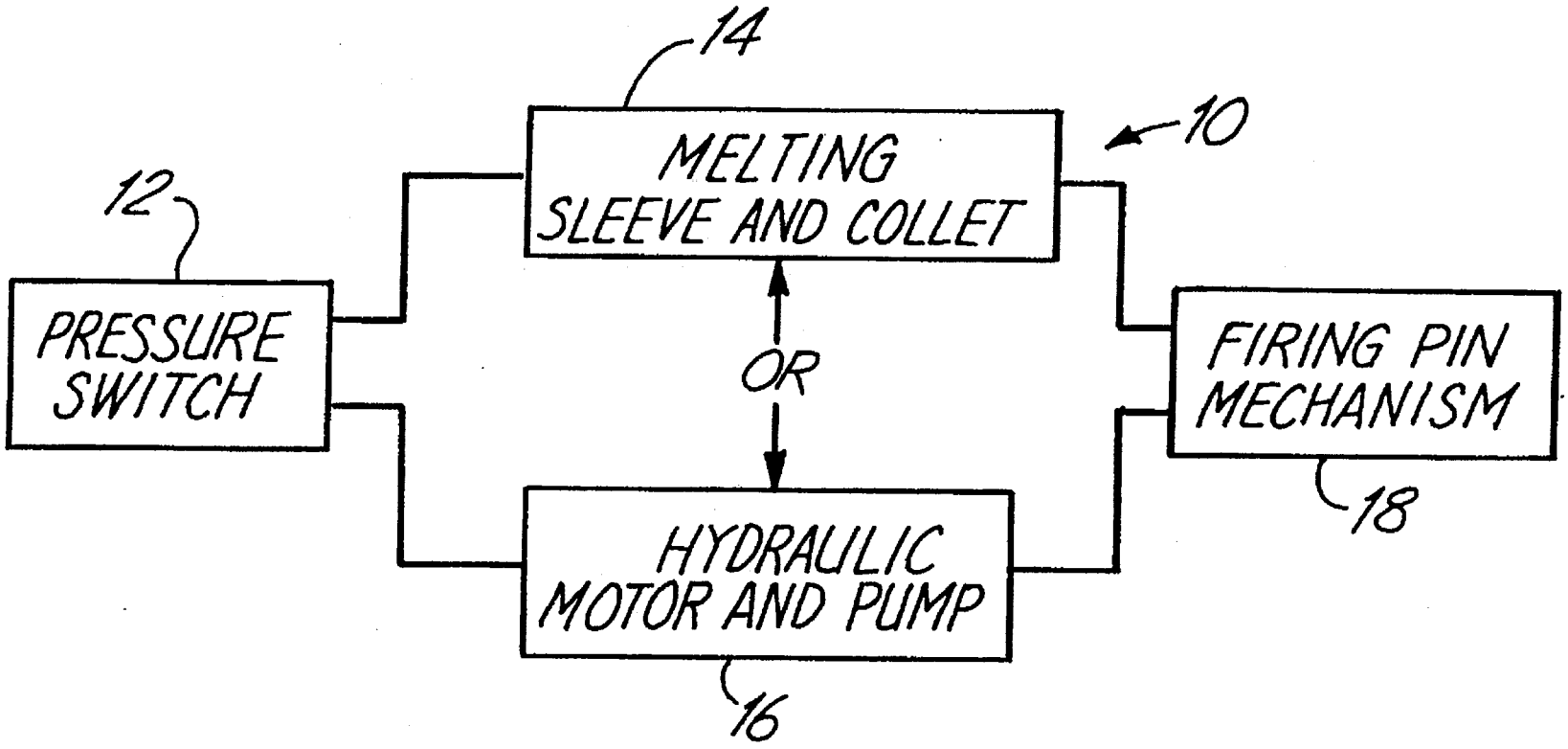
FIG. 1 is a block diagram of alternative structures of detonator systems in accordance with the present invention.

Referring now to the drawings in more detail, and particularly to FIG. 1, therein is depicted, in block diagram form, an exemplary detonation system 10 in accordance with the present invention. Detonation system 10 includes a pressure switch 12. Pressure switch 12 will be responsive to ambient pressure conditions proximate, and preferably, at the detonation system housing. In one particularly preferred embodiment, pressure switch 12 is responsive to pressure in the annulus exterior to the housing of detonation system 10. Pressure switch 12 will be responsive to such pressure to perform an operation precedent to actuation of firing pin mechanism 18. Preferably, this step will be the closing of an electrical switch to complete an electrical circuit. Described relative to detonation system 10 are two alternative second stage actuation mechanisms. A first mechanism is a meltable sleeve surrounding a collet mechanism 14. The meltable sleeve and collet mechanism 14, in one preferred implementation, is utilized to restrict movement of a firing pin mechanism 18. Once the meltable sleeve has melted, then the collet may move to release firing pin mechanism 18. An alternative second stage actuation mechanism is a hydraulic motor and pump 16. The hydraulic motor and pump may be utilized to establish a pressure differential within detonation system 10 to facilitate movement of firing pin mechanism 18.

Figure 2A:
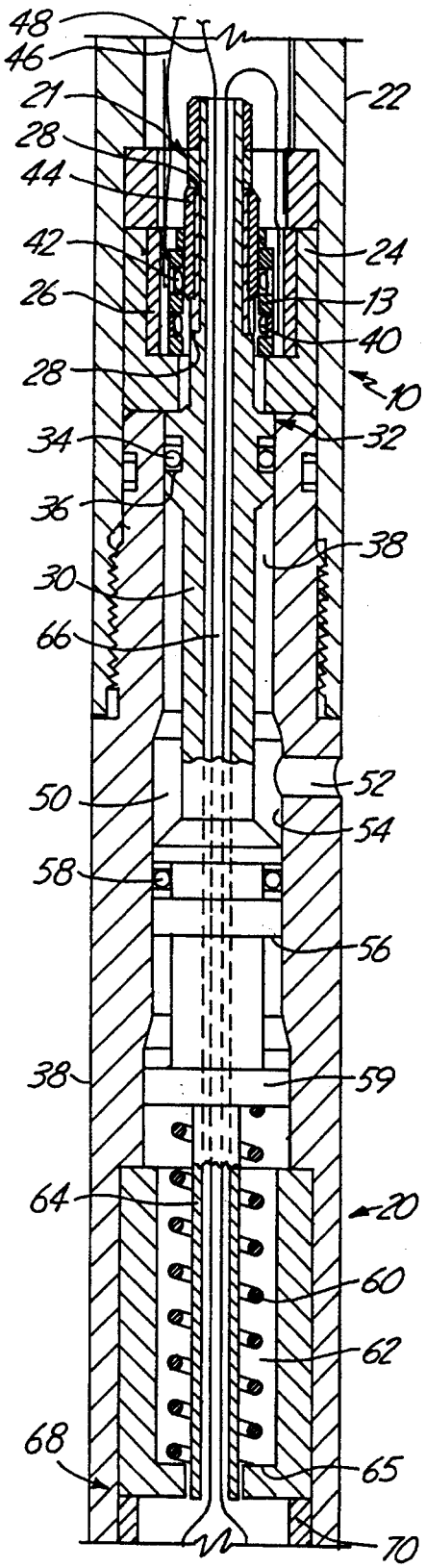
FIGS. 2A, 2B, 2C and 2D and 2E are successive sectional views along the length of an exemplary perforating assembly including a detonator system in accordance with the present invention, depicted partially in vertical section.

Referring now to FIGS. 2A, 2B, 2C, 2D and 2E, therein is depicted a perforating assembly, indicated generally at 20, including an exemplary detonator system 10 in accordance with the present invention. FIG. 2A depicts an exemplary pressure switch as identified at 12 relative to FIG. 1. Perforating assembly 20 includes a tubular sub 22 extending upwardly to engage a suitable conventional connector (not shown) to enable serial connection with additional equipment for lowering perforating assembly 20 into a borehole. Perforating assembly 20 will be suspended in the well borehole and will include a perforating gun supporting a plurality of shaped charges.

Sub 22 of perforating assembly 20 supports a switch mechanism, indicated generally at 21, including an internal mounting sleeve 24 on the interior to abut against an insulating sleeve assembly 26. Insulating sleeve 26 has a plurality of passageways formed into it for receiving electrical conductors. Sleeve 26 is positioned immediately adjacent to and concentric about an enlarged sleeve 28 formed of a similar insulating material located on the protruding upper end of a tubular moveable piston mandrel 30. Sleeve 28 serves to retain a conductive bridge 44 to move with mandrel 30, but to electrically insulate bridge 44 from mandrel 30. Piston mandrel 30 is constructed with an enlarged piston area, indicated generally at 32, receiving a seal 34 in a groove 36. Seal 34 is preferably an O-ring. O-ring seal 34 defines a first cross-sectional piston area.

Two metal contact rings 40, 42 are positioned on the interior of the insulating sleeve 13. Contact rings 40 and 42 form part of switch mechanism 21. Switch closure is obtained by moving conductive bridge 44 to a position where it straddles contact rings 40 and 42, establishing electrical contact between rings 40 and 42. Bridge 44 is carried on the exterior of insulative sleeve 28. When bridge 44 is in the up position (as depicted in FIG. 2A), there is no completed circuit. When bridge 44 moves downwardly (in response to pressure in the annulus surrounding the tool), bridge 44 spans the two contact rings 40 and 42 and completes an electrical connection. Contact rings 40 and 42 are interposed in an electrical circuit including conductors 46 and 48, which are coupled to a supply of electrical current. Preferably, conductors 46 and 48 are coupled through a wireline to a selectively controllable supply of electrical current at the earth's surface. However, conductors 46 and 48 may also be coupled, for example, to a supply of electrical energy elsewhere in the tool string. Preferably, such supply will be selectively switchable between "on" and "off" states. Conductors 46 and 48 extend downwardly through the system 10 and make connection with additional components as will be described later herein.

Housing 38 includes an internal chamber 50 which is in fluid communication with the tool exterior through a port 52. Chamber 50 is closed at one end by O-ring seal 34 defining the first cross-sectional piston area. At the other end, chamber 50 is defined in part by a bore 54 which is larger in diameter than bore 50, and by second enlarged piston area 56 on moveable mandrel 30 support and a seal 58 engaging bore 54 to form a second, larger, cross-sectional piston area. Fluid which enters chamber 50 through port 52 will be confined between O-ring seals 34 and 58.

Moveable mandrel 30 also includes a further enlarged shoulder 59. Shoulder 59 abuts a return spring 60 which is positioned in a chamber 62 in housing 38 below shoulder 59. Return spring 60 is confined by a thimble 64 having an inwardly directed shoulder 65. Thimble 64 is retained within housing 38 and provides support for return spring 60, which biases mandrel 30 toward a first, upper, position where switch mechanism 21 is "open".

Depending on the spring constant of the return spring 60, moveable mandrel 30 is forced upwardly to the limit of travel. This is achieved in the position depicted in FIG. 2A. In the depicted "up" position, the introduction of fluid under pressure from the tool exterior creates a force in chamber 50. Because the second cross-sectional piston area at seal 58 is greater than the first cross-sectional piston area at seal 34, the fluid in chamber 50 creates a larger force acting downwardly. When this force is sufficiently large, it will overcome the bias of return spring 60. When this actuation pressure is achieved, mandrel 30 will move downwardly, compressing return spring 60. When such downward movement occurs, the range of travel is sufficiently great that bridge 44, otherwise supported and surrounded only by insulative material, moves to a bridging position across metal rings 40 and 42, closing switch mechanism 21 and thereby completing an electrical circuit via conductors 46 and 48. Conductors 46 and 48 extend through a central bore 66 in mandrel 30 to an electrically responsive device, as will be described later herein.

Figure 2B:
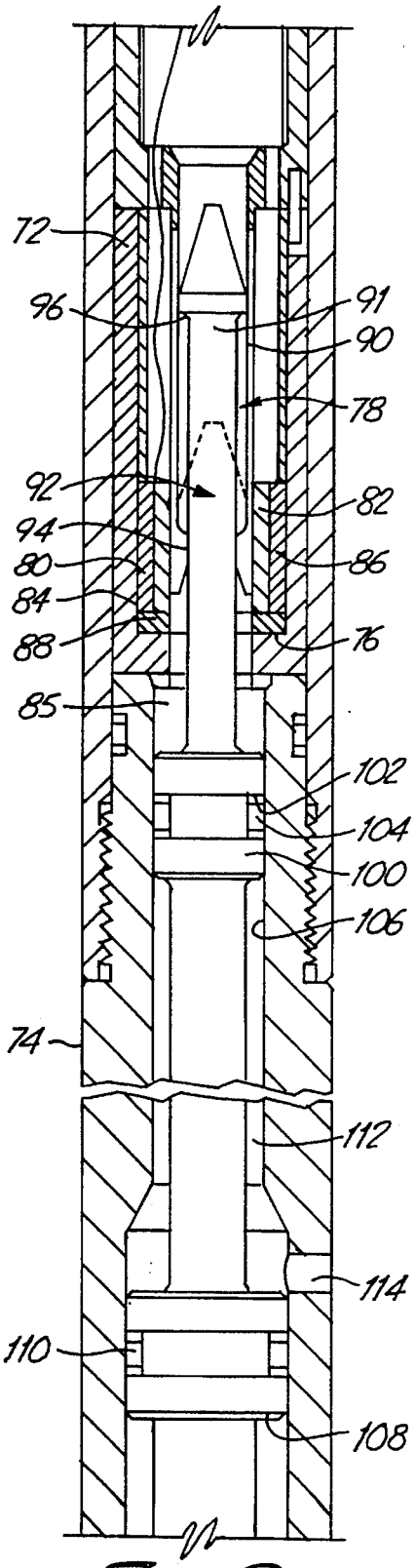

Turning now to the next section of system 10, FIG. 2B depicts meltable sleeve and collet assembly 14 of FIG. 1. Housing assembly 38 supports a sleeve assembly 68 on the interior. Sleeve assembly 68 includes a first member 70 and a second member 72. Member 72 is supported on the upper end of a threaded housing extension 74. Sleeve assembly 68 serves to position thimble 64 supporting return spring 60, as described above. First sleeve member 70 includes a downwardly extending collet assembly 78 which extends within second sleeve member 72. Second sleeve member 72 of sleeve assembly 68 includes an inwardly-directed shoulder 76 which supports meltable sleeve assembly 80 adjacent to, and surrounding, collet assembly 78.

Meltable sleeve assembly 80 includes a sacrificial alloy member 82 surrounded by a resistance-type wire heater 84. Sacrificial alloy member 82 can be eutectic metal or may be formed of an alloy such as conventional solder. Preferably, heater 84 is a flat strip heater. Such heaters can be obtained from Minco, Inc., of Minneapolis, Minn. Heater 84 is a terminating lead for electrical conductors 46 and 48. Current flow through the conductors 46 and 48 and through resistance strip heater 84 heats the cylindrical alloy member 82, which is constructed with an alloy selected to melt at a controlled predetermined temperature. A low temperature, e.g., such as 400–500 degrees Fahrenheit, is selected so that the alloy is readily melted, and when melted, it completely looses shape and flows downwardly, through a void 85 and out of the operative position shown in FIG. 2B of the drawings. Preferably, a thermally insulating sleeve 86 will extend externally and coaxially with strip heater 84, and a thermally insulative disk 88 will extend beneath heater 84. Thermally insulating sleeve 86 and disk 88 serve to minimize transfer of heat from heater 84 to sleeve assembly 68 and housing assembly 38. This assures that the heat of strip heater 84 is directed primarily to alloy member 82.

Collet assembly 78 includes a set of flexible collet fingers 90 positioned around, and encircling, an upstanding, longitudinally moveable, probe 91 on operating mandrel 92. Probe 91 is positioned so that it will slide downwardly through collet fingers 90 when collet fingers are deflected outwardly. Collet fingers 90 are equipped with inwardly protruding shoulders 94 located proximate the end of each collet finger 90. Collet fingers 90 and shoulders 94 are wedged or blocked from deflecting radially outwardly by alloy member 82 when such member is in its solid state, but are released when alloy member 82 is melted. An overhanging shoulder 96 located at the upper end of probe 91, blocks probe 91 from passing between shoulders 94. The blocking position defined at this juncture is held as long as the components have the shape illustrated in the drawings. Some movement of probe 91 is allowed, however, to facilitate equalization of down-hole pressures. When alloy member 82 is melted, collet fingers 90 are then free to flex radially outwardly, thereby allowing shoulder 96 to pass, and releasing probe 91 and operating mandrel 92 for downward movement.

Operating mandrel 92 includes an enlargement 100 which supports an annular groove 102 and O-ring seal 104. O-ring seal 104 seals within a bore 106 in housing extension 74 to establish a third piston area. Below this third piston area, operating mandrel 92 includes a second, larger, enlargement 108, again having an O-ring seal 110, forming a fourth, larger, piston cross-sectional area in housing extension 74. Housing extension 74 and the third and fourth piston areas cooperatively form a second chamber 112 in housing extension 74. Housing extension 74 includes a port 114 to provide a fluid passage to chamber 112. The diameter of the piston area at seal 104 is less than the diameter of the fourth piston area, at seal 110.

In summary, during operation of the described embodiment, the capability of movement of operating mandrel 92 is dependent on the hydrostatic pressure introduced through the port 114 (FIG. 2B), creating a force imbalance (because the fourth piston area, at seal 110 is larger than the third piston area at seal 102). This force imbalance urges operating mandrel 92 to move downwardly. Operating mandrel 92 is initially restrained against downward movement by collet shoulders 94 engaging shoulder 96 on probe 91. After movement of piston mandrel 30 in response to pressure as previously described, metal bridge 44 is positioned across contact rings 40 and 42 thereby allowing electrical current flow through the conductors 46 and 48. Consequently, when current is applied for a sufficient duration the energy in the conductors 46 and 48 heats the resistance wire, thereby liberating sufficient heat to melt sacrificial alloy member 82. When melted, the alloy member 82 is no longer able to hold its shape, thereby allowing shoulders 94 at the end of the collet fingers 90 to deflect radially outwardly. This provides clearance for overhanging shoulder 96 of probe 91. This clearance permits downward movement of probe 91 subject to the external hydrostatic pressure, introduced through port 114. Because the fourth piston area at seal 110 is larger than the area at seal 104, this pressure causes the probe 91 to move downwardly in response to the hydrostatic pressure.

Figure 2C:
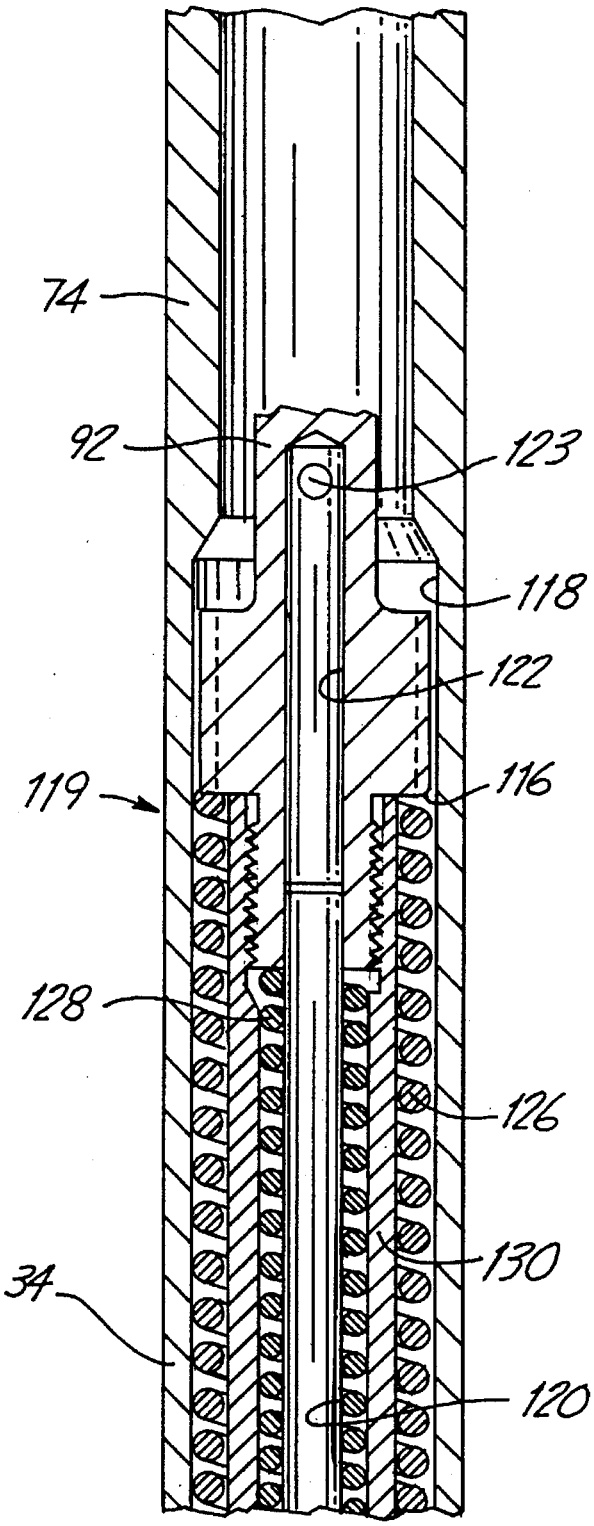
Figure 2D:
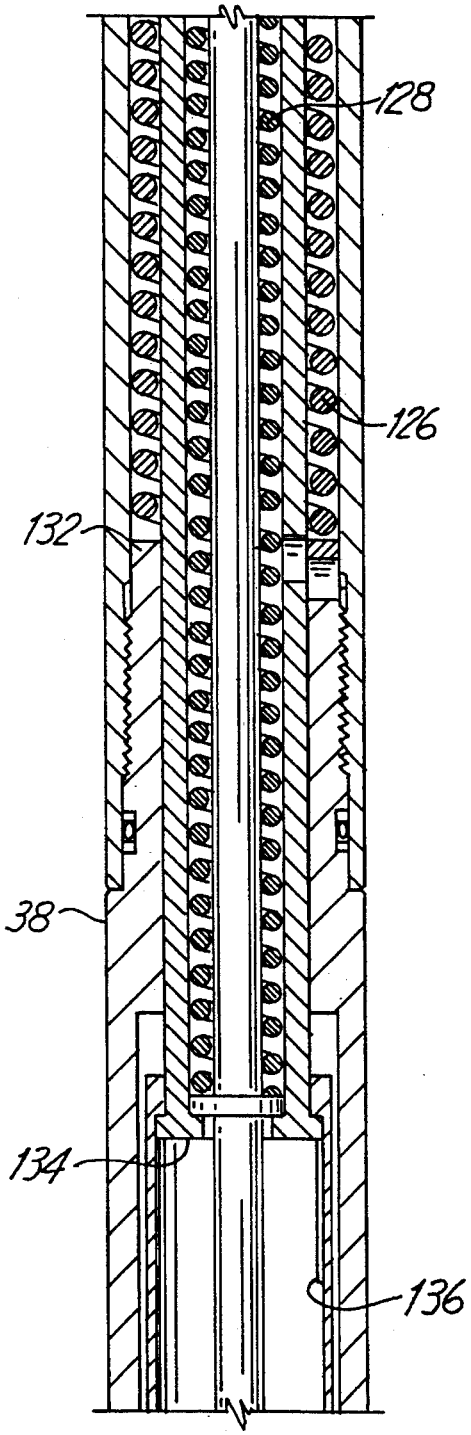
Figure 2E:
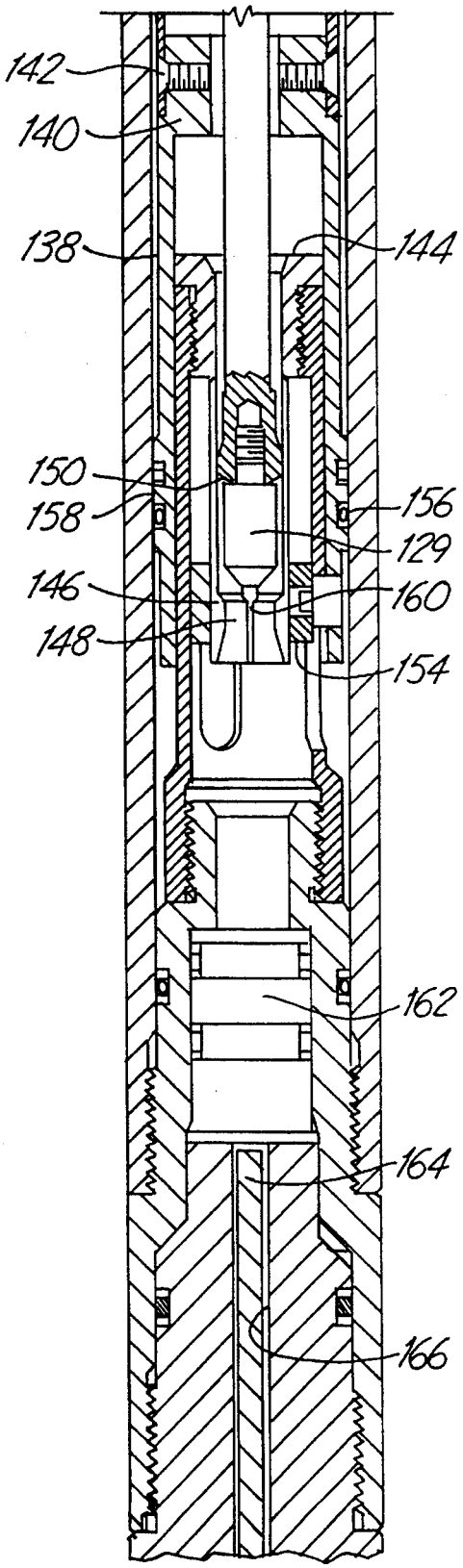

Referring now to FIGS. 2C–2E, therein is depicted an exemplary firing pin mechanism (element 18 in FIG. 1 ). Housing extension 74 extends around and below operating mandrel 92 which is provided with a slotted enlargement 116, enlargement 116 being received in an interior bore 118 having a larger diameter, resulting in a thin-wall construction for the adjacent portion 119 of housing assembly 74. Enlargement 116 serves as a guide for operating mandrel 92 during movement.

Operating mandrel 92 is axially hollow to receive the upper end of a moveable firing pin assembly 120. Firing pin assembly 120 is received in an internal passage 122 which is pressure-equalized through a port 123 opening to the exterior of operating mandrel 92. External drilling fluid does not flow into this region because it is prevented from flowing below seal 110 (Fig. 2B). This part of the interior is therefore isolated from the tool exterior, but pressure equalization on both the exterior and interior of operating mandrel 92 within housing 34 is accomplished through port 123. Enlargement 116 includes a shoulder which abuts actuation spring 126 located concentrically around operating mandrel 92. Actuation spring 126 thereby compresses when operating mandrel 92 moves downwardly. Actuation mandrel 92 is threaded to a hollow extension mandrel 130, which defines an axial chamber to receive firing pin assembly 120 and firing pin spring 128. An internal shoulder 132 on housing assembly 34 supports the lower end of actuation spring 126. All of these housing components have a common external diameter and thread together in sections in a conventional manner to enable the structure to be assembled and disassembled to provide access to the tool interior. The extension mandrel 130 affixed to operating mandrel 92 extends to a inwardly directed shoulder 134 at the lower end, thereby establishing a lower support for firing pin spring 128, which cooperates with firing pin 129, as will be described below.

Shoulder 134 extends radially inwardly and outwardly, and, on the exterior, telescopes inside of and hooks to a concentrically located, relatively thin wall, hollow sleeve 136. Referring to the bottom part of the structure in FIGS. 2D–E, firing pin 129 is positioned on the interior of sleeve 136. Sleeve 136 is joined to an extension 138, and the two jointly extend downwardly within housing assembly 38. Joinder is accomplished at an internal projecting rib 140, and suitable fasteners 142 are utilized to hold sleeve 136 and extension 138 together. A ring 144 is positioned on the interior of sleeve 138 and supports a set of downwardly projecting collet fingers 146. Ring 144, with the integrally formed collet fingers 146, supports an inwardly extending shoulder 148 cooperatively formed by the lower ends of the collet fingers 146. Shoulder 148 engages an annular ledge 150 on firing pin 129. Ledge 150 is sufficiently large in diameter that it cannot pass through the shoulder 148. Shoulder 148 would ordinarily deflect radially outwardly as the collet fingers are bent. Such movement is not permitted, however, due to the presence of a retaining ring 154 around collet fingers 146 proximate shoulder 148. Retaining ring 154 is fastened to sleeve extension 138. This assembly restrains firing pin assembly 120 from moving downwardly.

Release of firing pin 129 is accomplished by releasing collet fingers 146 so that shoulder 148 deflects outwardly, permitting firing pin assembly 129 to move rapidly downwardly. The foregoing release is accomplished by downward movement of shoulder 134 (FIG. 2D) when operating mandrel 92 is allowed to move downwardly, as previously described. Movement of operating mandrel 92 allows sleeve 136 and extension 138 to move downwardly as a unit. Extension sleeve 138 is sealed, at 156, around the exterior by a seal ring 158 which thereby provides a modest amount of frictional drag to retard movement. When the friction is overcome, sleeve 136 and sleeve extension 138 jointly move retaining ring 154 which is pinned to extension 138. Retaining ring 154 is forced longitudinally away from shoulder 148 on collet fingers 146, thereby releasing collet fingers 146 to deflect, and unlocking firing pin assembly 120. Firing pin 129 then causes shoulder 148 to deflect, and travels downwardly so that tip 160 strikes detonator 162 below. This input causes detonation of the perforating charges. When detonator 162 is actuated, a length of primacord 164 located in passage 166 communicates the detonation to the explosive charges in the tool, in a conventional manner.

Figure 3:
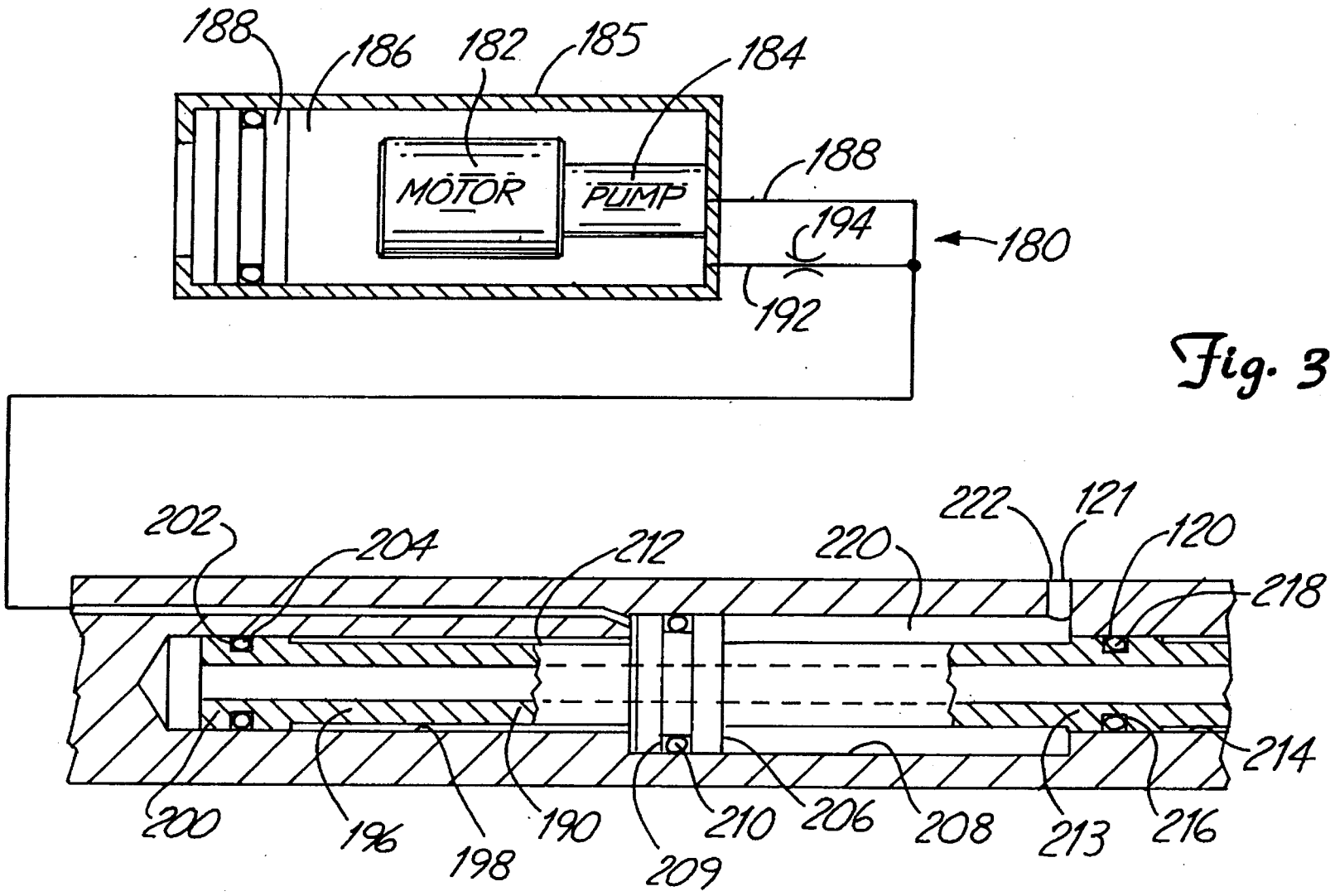
FIG. 3 depicts an alternative embodiment of actuation mechanism in accordance with the present invention and as identified in FIG. 1, depicted partially in schematic view and partially in vertical section.

As depicted in FIG. 1 as element 16, an alternative embodiment of detonation system in accordance with the present invention utilizes an electric motor and pump as the second actuation mechanism. An exemplary mechanism 180 is depicted in FIG. 3, partially in schematic form. Preferably, the electric motor and pump assembly will be utilized with a pressure actuated switch as depicted in FIG. 2A and a firing pin mechanism as depicted in FIGS. 2C-E. Accordingly, the structure of FIG. 3 may be considered as an alternative structure to that of FIG. 2B. Motor and pump system 180 utilizes an electric motor/hydraulic pump arrangement which is balanced (referenced) to the ambient pressure acting on the exterior of the tool to actuate the spring energized firing pin mechanism 18 (FIG. 1). The advantage of this system is that without electrical input to the motor, absolutely no stored potential energy is present in the firing system, regardless of the magnitude of the hydrostatic pressure acting on the exterior of the tool. In order for the system to fire, a sustained and distinct electrical excitation must be input to the motor/pump arrangement which, in turn, produces pressured hydraulic fluid at a level substantially greater than ambient pressure. This pressurized hydraulic fluid produces the mechanical energy needed to actuate the spring-energized firing pin mechanism 18.

Figure 4A:
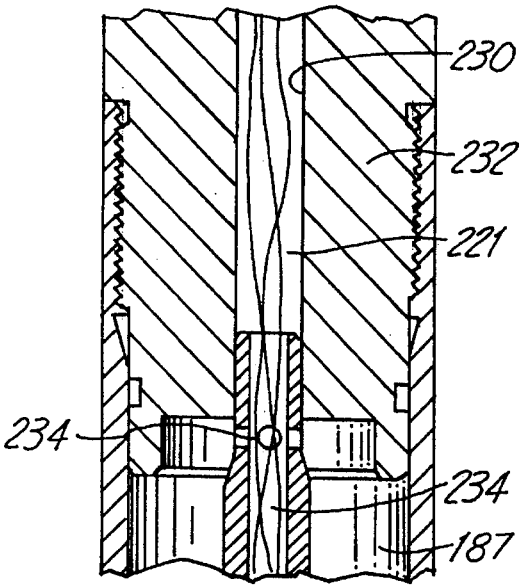
FIGS. 4 A, B, and C are successive section views of an exemplary device in accordance with FIG. 3.
Figure 4B:
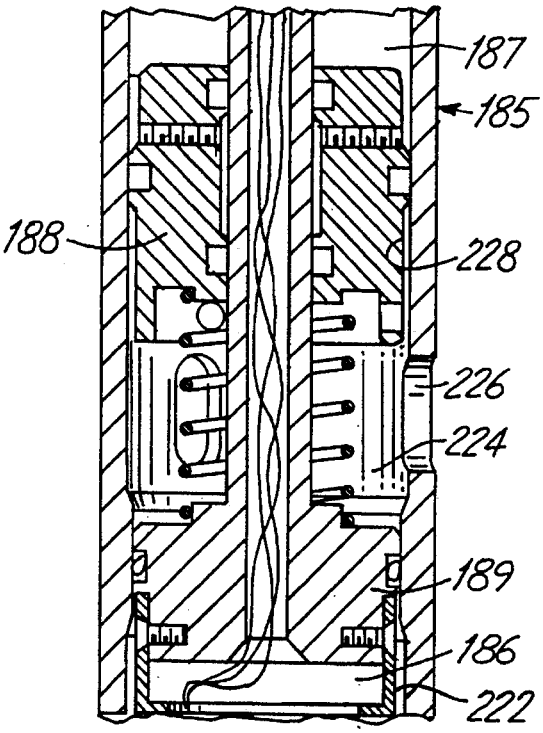
Figure 4C:
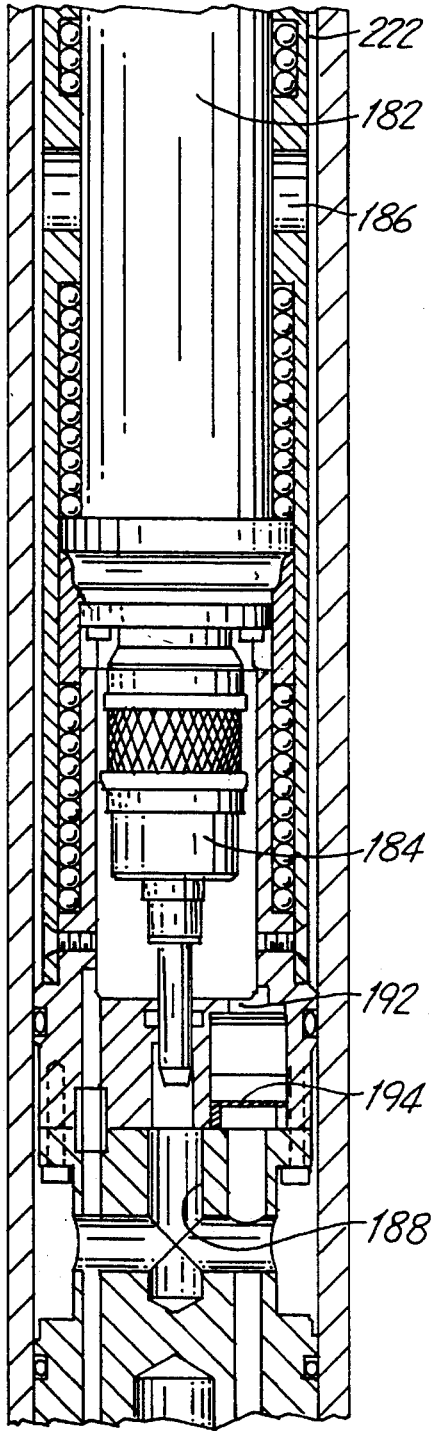

As depicted in FIGS. 3 and 4A–C, partially in schematic form in FIG. 3, and in vertical section of FIGS. 4A–C, motor and pump assembly 180 includes motor 182 and pump 184 which are coupled together within a portion of a housing assembly 185. Housing assembly 185 can be substantially as depicted relative to housing assembly 38 of FIGS. 2A–E. However, as shown in FIG. 4, appropriate changes to the structure of the housing assembly may be made to accommodate the disclosed system. Such changes will be apparent to those skilled in the art.

Motor 182 and pump 184 operate within a fluid reservoir 186 formed within housing assembly 185 which is pressure balanced, through use of a moveable piston 188 within housing assembly 185. Upon actuation of motor 182 to operate pump 184, fluid will be pumped from reservoir 186 through a passageway 188 to contact an actuation mandrel 190 defining a plurality of piston areas within housing assembly 185. A return fluid passageway 192 is provided from passage 188 to reservoir 186, with such return fluid passageway 192 including a fluid restrictor 194 which allows pump 184 to build pressure in passageway 188 which may subsequently be relieved through restrictor 194 in passageway 192 when pump 184 is deactivated. Actuation mandrel 190 has an upper-end 196 which extends within a bore 198 formed within housing assembly 185. Actuation mandrel 190 includes an upper radial enlargement 200, including an annular groove 202 housing an O-ring seal 204 to define an upper piston area.

Actuation mandrel 190 also includes a central radial enlargement 206 which is moveable within a second, larger, bore 208 of housing assembly 185. Enlargement 206 again includes a groove 209 housing an O-ring seal 210 to define an intermediate piston area. As can be seen in FIG. 3, the piston areas between seals 204 and 210 define a chamber 212 in direct fluid communication with fluid passageway 188. Accordingly, chamber 212 may be pressurized by actuation of pump 184. Due to the cross-sectional differential area between seals 210 and 204, the application of pressure will promote downward movement of actuation mandrel 190.

Actuation mandrel 190 also includes a lower radial enlargement 213 moveable within a third, smaller, bore 214 in housing assembly 185. Enlargement 213 again includes an annular groove 216 housing an O-ring seal 218. The area within housing assembly 185 between O-ring seals 210 and 218 defines a chamber 220 which is in fluid communication, through a port 222 with the exterior of housing assembly 185. Actuation spring 126 acting against mandrel 92 (FIGS. 2B, 2C) will return or bias mandrel 190 (FIG. 3) to its uppermost position. However, pressurization of passageway 188, and thereby chamber 212, will cause actuation mandrel 190 to move downwardly, having the same effect as moving operating mandrel 92 of FIGS. 2B–C downwardly, so as to allow downward movement of sleeve 138 and of firing pin actuation mechanism 18 (in FIG. 1) extension sleeve 138 downwardly as to remove ring 154 from proximate lower portions of collet fingers 146 (see FIG. 2E), thereby enabling actuation of firing pin assembly 120 in the manner previously described.

This system having been described schematically, a physical representation is depicted and will be briefly discussed relative to FIGS. 4A–C. Referring specifically to FIGS. 4A–C, therein is depicted an exemplary mechanical configuration for the construction of motor and pump mechanism 180. Motor 182 rotates an attached pump 184 which connects with a hydraulic circuit which has a high pressure side and a low pressure return line consistent with the structure of FIG. 3. A piston 188 separates a housing chamber 224 which is open to wellbore fluids through a port 226, from a first reservoir 187. Piston 188 is longitudinally movable and sealingly engaged with seal bore 228. Beneath a bulkhead 189 is a second reservoir 186, in which motor 182 and pump 184 are retained. Bulkhead 189 is coupled to an extension 222 which engages motor 182. Movement of piston 188 and of bulkhead 189 facilitates equalization of pressure between chambers 224, 187 and 186. In this preferred embodiment, a sump portion 221 is provided to increase the volume of fluid retained within the tool. Sump 221 occupies a central bore 230 in sub 232, and within housing assembly 185. Sump 221 is in fluid communication with chamber 187, and with chamber 186 through a passage 234 bulkhead 188.

The various embodiments herein are responsive to achieving two different and specific operative or "arming" conditions. One condition is maintenance of a required pressure to the tool. Preferably, that pressure level is chosen so that it is a high hydrostatic pressure level of the sort not accomplished until the tool is substantially deep in the well borehole. The second condition is the furnishing of the requisite power signal. That is, the signal must have an appropriate current flow, and must be sustained for an appropriate interval. While these can be varied depending on scale factors, they represent a sequence of events which minimizes the risk of false triggering of the equipment when it is at the surface.

While the foregoing discussion is directed to the various illustrated embodiments, the scope the present invention is not so limited but, rather, is determined by the claims which follow:

What is claimed is:

1. An explosive charge assembly for use in an earth borehole to detonate an explosive charge therein, comprising:

a housing assembly adapted for movement within said borehole;

an explosive charge assembly including an impact responsive detonation charge retained at least partially within said housing assembly;

a firing pin assembly movably secured within said housing and adapted to be moveable from a first, unactuated, position to a second, actuated, position, at which a firing pin of said firing pin assembly will impact said detonation charge;

a first arming assembly responsive to fluid pressure, said first arming assembly adapted to move from a first position to a second position, said second condition being a condition precedent to actuation of said firing pin assembly;

a second arming assembly, said second arming assembly cooperatively coupled to said first arming assembly, said second arming assembly being moveable from a first condition to a second condition, said second condition being a condition precedent to actuation of said firing pin assembly, and wherein movement of said second arming assembly to said second condition is dependent upon said first arming assembly having moved from said first condition to said second condition.

2. The explosive charge assembly of claim 1, wherein said first arming assembly is responsive to fluid pressure exterior to said housing assembly.

3. The housing assembly of claim 2, wherein said first arming assembly comprises an electrical switch, and wherein in said first condition said electrical switch is open, and wherein in said second position said electrical switch is closed.

4. The explosive charge assembly of claim 1, wherein said second arming assembly is responsive to an electrical signal to move from said first condition to said second condition.

5. The explosive charge assembly of claim 4, wherein said first arming assembly comprises an electrical switch, and wherein said electrical signal is communicated in part to said second arming assembly through said electrical switch of said first arming assembly.

6. The explosive charge assembly of claim 1, wherein said first arming assembly comprises an electrical switch, and wherein said first arming assembly is responsive to fluid pressure to move from said first condition wherein said switch is opened to said second condition wherein said switch is closed; and wherein said second arming assembly comprises, an operating mandrel arranged for longitudinal movement within said housing from a first position to a second position, wherein said operating mandrel being in said first position precludes actuation of said firing pin assembly, and wherein placement of said operating mandrel in said second position allows actuation of said firing pin assembly, and an electrically removable mechanical barrier retaining said first operating mandrel in said first position.

7. An explosive charge assembly for use in a borehole to detonate an explosive charge in the borehole, comprising:

a housing assembly adapted to be lowered into a borehole;

an explosive charge assembly including an impact responsive detonation charge retained within said housing assembly;

a firing pin assembly movably arranged in said housing to move from a first, unactuated, position to a second, actuated, position, at which a firing pin strikes said detonation charge supported by said housing to detonate said detonation charge;

a pressure-operated firing-pin enabling assembly in said housing having an initial disarmed condition and an armed condition, said pressure operated firing pin assembly responsive to fluid pressure to change from said disarmed condition to said armed condition;

an electrically-operated firing-pin enabling assembly in said housing having an initial, disarmed, condition and an armed condition, said electrically operated firing pin enabling assembly dependent upon said pressure operated firing pin enabling assembly being in said armed condition to move between from said disarmed to said armed condition; and a surface-controlled power supply selectively coupleable to said electrically-operated firing pin enabling assembly for providing a current flow sufficient to cause said electrically operated firing pin enabling mechanism to move from said initial disarmed condition to said armed condition, to enable said firing pin to strike said detonating charge with sufficient force to actuate said detonating charge and to result in detonation of said explosive charge.

8. The apparatus of claim 7 wherein said detonating charge is positioned proximate a lower end of said housing assembly.

9. The apparatus of claim 7 wherein said pressure-operated firing-pin enabling assembly includes a piston in fluid communication with fluid exterior to said housing assembly.

10. The apparatus of claim 9 wherein said pressure-operated firing-pin enabling assembly comprises a spring providing a biasing force against said piston.

11. The apparatus of claim 7 wherein said electrically-operated firing-pin enabling assembly includes a meltable member coupled to said firing-pin assembly to retain said firing pin assembly in said first, unactuated, position.

12. The apparatus of claim 7 wherein said electrically-operated firing-pin enabling mechanism comprises an electrically operated motor and pump.

13. A perforating assembly for use in an earth borehole to detonate at least one explosive charge in said borehole, comprising:

a housing assembly;

an explosive charge assembly contained at least partially within said housing assembly, said explosive charge assembly comprising an impact responsive detonation charge;

a firing pin assembly retained within said housing and arranged for longitudinal movement between a first unactuated position and a second position wherein said firing pin assembly provides said impact to actuate said detonation charge;

a first piston assembly within said housing assembly, said piston assembly adapted for movement in response to fluid pressure exterior to said housing, said first piston assembly including an electrical switch assembly, said piston assembly moveable from a first position to a second position operable to move said electrical switch assembly from an open position to a closed position;

a retention assembly comprising a mandrel which is longitudinally moveable in response to hydraulic pressure from a first position to a second position, wherein in said first position said firing pin assembly is precluded from movement and wherein in said second position said firing pin assembly is allowed to move from said first position to said second position, said retaining assembly operable in response to an electrical current supplied through said switch assembly.

14. The perforating assembly of claim 13, wherein said retention assembly comprises:

a meltable member proximate said mandrel and coupled thereto to preclude movement of said mandrel to said second position when said meltable member is in a solid state; and an electrically responsive heating member adapted to selectively induce melting of said meltable member in response to an electrical current through said switch assembly.

15. The perforating assembly of claim 13, wherein mandrel of said retention assembly is biased towards said first, unactuated, position by pressure in said borehole exterior to said housing, and wherein said retention assembly further comprises an electrically responsive motor and pump assembly arranged to selectively move said operating mandrel to said second position in response to an electrical signal through said switch.

* * * * *